US007273086B2

(12) United States Patent
Richter et al.

(10) Patent No.: US 7,273,086 B2
(45) **Date of Patent: *Sep. 25, 2007**

(54) LUBRICANT FOR IMPROVED SURFACE QUALITY OF CAST ALUMINUM AND METHOD

(75) Inventors: Ray T. Richter, Murrysville, PA (US); Brian C. Reynolds, Davenport, IA (US); Jim N. Hart, Davenport, IA (US); Patricia A. Stewart, Pittsburgh, PA (US); James R. Anglin, Export, PA (US); Larry F. Weiserman, Apollo, PA (US); Thomas J. Kasun, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 309 days.

This patent is subject to a terminal disclaimer.

(21) Appl. No.: 10/974,384

(22) Filed: Oct. 26, 2004

(65) Prior Publication Data

US 2006/0089267 A1 Apr. 27, 2006

(51) Int. Cl.
*B22D 11/07* (2006.01)
*B28B 7/36* (2006.01)

(52) U.S. Cl. ..... 164/472; 164/268; 164/72; 508/154; 106/38.24

(58) Field of Classification Search ..... 164/472, 164/268, 122, 72, 138; 508/154, 156; 106/78.24
See application file for complete search history.

(56) References Cited

U.S. PATENT DOCUMENTS

| | | | | |
|---|---|---|---|---|
| 4,336,147 | A * | 6/1982 | Stayner | 508/156 |
| 4,775,418 | A * | 10/1988 | Laemmle et al. | 106/38.24 |
| 6,269,862 | B1 * | 8/2001 | Richards et al. | 164/472 |
| 6,334,978 | B1 | 1/2002 | DeYoung et al. | 420/529 |
| 6,412,164 | B1 | 7/2002 | DeYoung et al. | 29/527.5 |
| 6,725,904 | B2 * | 4/2004 | Desrosiers et al. | 164/444 |

FOREIGN PATENT DOCUMENTS

JP 2000015419 * 1/2000

* cited by examiner

*Primary Examiner*—Patrick Joseph Ryan
(74) *Attorney, Agent, or Firm*—Greenberg Traurig LLP; Mauri A. Sankus

(57) ABSTRACT

In a lubricant composition suitable for use in the manufacture of aluminum alloys comprising lubricant base selected from the group consisting of solid lubricants, liquid lubricants, grease lubricants, emulsion lubricants, and dispersion lubricants, the improvement wherein the lubricant composition further comprises: an effective amount of water and surfactant. It is believed that mixing oil with water and surfactant provides a method for uniformly distributing the surface oxide at the meniscus for casting applications. Uniform distribution of the oxide at the meniscus reduces vertical fold formation that can lead to cracks in the aluminum ingot. In addition, the mixture promotes uniform heat transfer around the mold. Uniform heat transfer around the mold allows the solidifying aluminum alloy to stay in contact with the mold longer and form stronger ingot shells. A process for continuous or semi-continuous casting of aluminum alloys via the use of this lubricant composition is also disclosed.

35 Claims, 4 Drawing Sheets

LUBRICANT FOR IMPROVED SURFACE QUALITY OF CAST ALUMINUM AND METHOD

FIELD OF THE INVENTION

The invention relates to lubricant formulations for use in the casting of aluminum or aluminum alloy ingots or bodies. In particular, the invention relates to using lubricants containing water and surfactants to improve the surface quality of cast ingots or bodies, resulting in enhanced product recovery. A method for producing aluminum or aluminum alloy ingots with enhanced surface quality is also disclosed.

BACKGROUND OF THE INVENTION

The casting of alloys may be done by any number of methods known to those skilled in the art, such as direct chill casting (DC), electromagnetic casting (EMC), horizontal direct chill casting (HDC), hot top casting, continuous casting, semi-continuous casting, die casting, roll casting, and sand casting.

Each of these casting methods mentioned above has a set of its own inherent problems, but with each technique, surface imperfections can be an issue. In the aluminum alloy casting art, molten metal (or melt for brevity) surface oxidation can produce various surface imperfections in cast ingots such as pits, vertical folds, oxide patches and the like, which can develop into cracks during casting or in later processing. A crack in an ingot or slab propagates during subsequent rolling, for example, leading to expensive remedial rework or scrapping of the cracked material. One mechanical means of removing surface imperfections from an aluminum alloy ingot is scalping. Scalping involves the machining off a surface layer along the rolling faces of an ingot after it has solidified. However, scalping results in lost metal.

Rectangular ingot yields for high magnesium alloys, such as 7050 and other 7xxx alloys as well as 5182 and 5083 alloys are especially prone to surface defects and cracking caused by initiation at vertical folds on the surface of the ingot. In the past, beryllium has been added, usually at part per million (ppm) levels to some of these alloys to control melt surface defects, and to prevent magnesium loss due to oxidation. In addition, materials, especially those containing fluorine, such as boron trifluoride and ammonium fluoroborate, have been used to promote uniform oxide distribution and therefore reduce surface defects and cracking. However, the use of these additives can be very costly and beryllium itself may fall into disuse due to allegations regarding health, disposal, and environmental issues that it creates. Furthermore, the use of gases can create toxic and corrosive gaseous atmospheres. For these reasons, suitable replacement strategies to control the nature of oxides during casting are needed.

In the casting of aluminum alloys it is also known in the art to use a mold lubricant. Satisfactory ingot surfaces can be obtained using a lubricant that is effective in keeping aluminum from sticking to the mold at high temperatures used in casting aluminum alloys. In early casting practices, greases were commonly employed as mold lubricants. However, with the advent of modern casting methods, including continuous or semi-continuous casting, free flowing oils have been used to provide continuous lubrication and have replaced the use of greases as mold lubricants.

Continuous casting refers to the uninterrupted formation of a cast body or ingot. For example, the body or ingot may be cast on or between belts, as in belt casting; between blocks, as in block casting; or in a mold or die that is open at both ends, as in direct chill (DC) casting. Casting may continue indefinitely if the cast body is subsequently cut into desired lengths. Alternately, the pouring operation may be started and stopped when an ingot of desired length is obtained. The latter situation is referred to as semi-continuous casting.

Continuous lubrication is required for fully continuous casting and offers a number of advantages for semi-continuous casting. These advantages include substantial reduction of flame and smoke, substantial reduction of dragging and tearing tendencies near the end of the cast, and allowing casting practices that produce better quality and more uniform surfaces.

Despite the use of continuous lubrication during casting, a limitation of current ingot casting practice exists in the non-uniform growth of oxide at the meniscus of molten metal at the mold interface. Non-uniform oxide growth at the meniscus of the molten metal and mold interface is particularly problematic for alloying elements that rapidly oxidize in air or in air containing moisture. For example, alloys containing lithium and magnesium may oxidize rapidly and in both cases, the vapor pressure of the element is higher than that of aluminum. As a result, magnesium and lithium may diffuse to the surface of the ingot and react with oxygen or moisture in the ambient air.

Distribution of the surface oxide on the ingot head and at the meniscus plays an important role in fold prevention or formation. Data from previous research shows that humid air can produce an oxide/hydroxide film that protects magnesium-containing alloys from runaway or uncontrolled magnesium oxidation at molten metal temperatures. Since the weight gain of the magnesium-containing alloy is significantly reduced in humid air as compared to dry air, the oxide layer is thinner and the oxide distribution is believed to be more uniform. Another mechanism that plays a part in the transformation of molten metal to solid metal is the heat transfer at the mold wall between the molten metal and lubricant coated mold wall.

There remains a need for an effective alternative to beryllium and fluorine containing materials to prevent surface imperfections, such as vertical folds, pits, oxide patches and the like from forming during aluminum ingot casting, and to control the nature and distribution of oxides, particularly when casting aluminum that is alloyed with elements like magnesium and lithium. Such an invention would be instrumental in preventing cracks, which can form during casting or can develop in later processing. Finally, the invention preferably would have no adverse affect on alloy properties.

The primary object of the present invention is to provide a lubricant composition that allows for uniform distribution of surface oxide at the meniscus formed between the molten aluminum and the mold during the continuous and semi-continuous casting of aluminum alloy ingots.

Another object of the present invention is to provide a lubricant composition that promotes a uniform and controlled rate of heat transfer at the interface formed between the molten aluminum and the mold during the continuous or semi-continuous casting of aluminum alloy ingots.

A still further object of this invention is to provide a casting lubricant that promotes uniform oxide distribution without requiring the use of toxic and corrosive gaseous atmospheres, and thus eliminating associated emissions and equipment corrosion.

Still another object of this invention is to provide a method that promotes uniform oxide distribution on aluminum alloy ingots or castings that does not require beryllium additions to the alloy and fluorine containing atmospheres.

These and other objects and advantages are met or exceeded by the instant invention, and will become more fully understood and appreciated with reference to the following description.

SUMMARY OF THE INVENTION

In the present invention it is believed that when water and surfactant are added to casting lubricants, the improved lubricant formulation can provide a method for uniformly distributing the surface oxide at the meniscus. Uniform distribution of the oxide at the meniscus reduces vertical fold formation that can lead to cracks in the aluminum ingot. In addition, the mixture promotes uniform heat transfer around the mold. Uniform heat transfer around the mold allows the solidifying aluminum alloy to stay in contact with the mold longer and form a thicker and stronger ingot shell. Water has an extremely high heat of vaporization when compared to other liquids that can further pull heat away from the meniscus and be affecting this interaction. Uniform heat transfer will also lead to reduced vertical fold formation and associated cracking.

Water and surfactant are added to existing lubricant bases to prepare the lubricant formulations of this invention. The lubricant formulation is mixed in a high speed mixing operation, such as blending or shearing, or any other mixing operation known by those skilled in the art to provide dispersions, emulsions, and/or true solutions. At this stage, the formulation is ready to use as a casting lubricant.

In the process of casting aluminum alloy ingots, the lubricant formulation of this invention is supplied to the oil ring of a cooled continuous or semi-continuous casting mold, which subsequently lubricates the inner wall of the continuous casting mold. Molten aluminum alloy is cast into the mold. It is believed that the lubricant allows for uniform distribution of the surface oxide at the meniscus of the lubricated inner mold wall and the molten aluminum base alloy interface.

DETAILED DESCRIPTION OF PREFERRED EMBODIMENTS

The instant invention provides a casting lubricant formulation and method for using this formulation that substantially reduce vertical fold formation that can lead to cracks in an aluminum ingot. In particular, it is believed that practice of the instant invention allows for uniform distribution of the surface oxide at the meniscus of the molten aluminum alloy. In addition, practice of the instant invention leads to uniform heat transfer around a casting mold.

Figure 1:
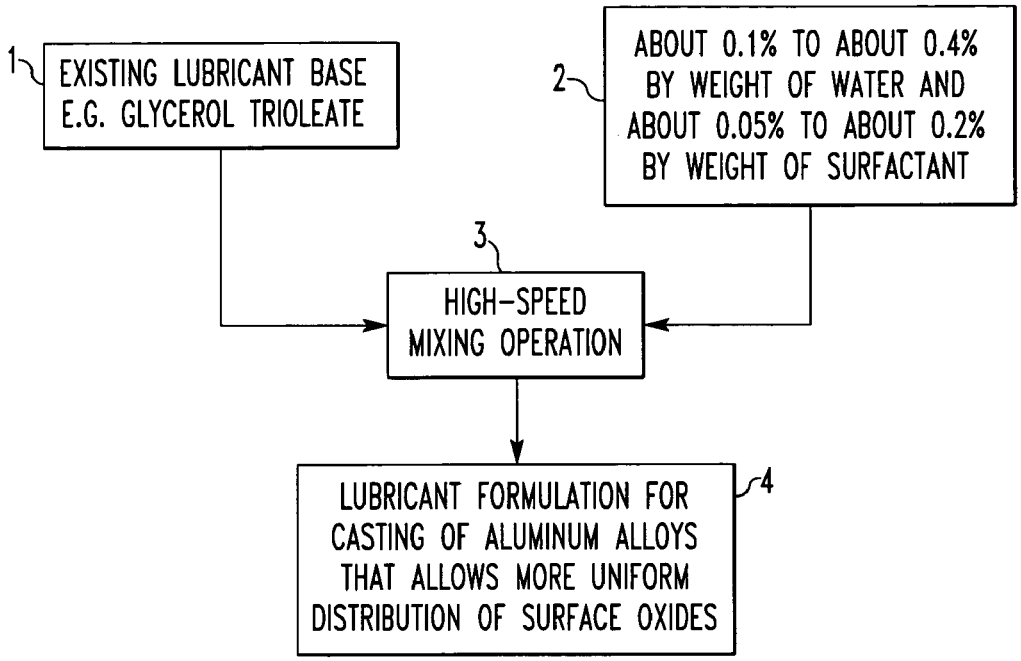
FIG. 1 is a flowchart for preparation of the formulation of the lubricant of the instant invention.

Referring now to FIG. 1, a flowchart for preparation of the lubricant of this invention is presented. The invention improves on existing lubricants used in the casting of aluminum and aluminum base alloy ingots and forms, and in the general manufacture of aluminum products, using thermomechanical processes such as, but not limited to, casting, extrusion, hot and cold rolling, and forging.

In a preferred embodiment, an existing aluminum alloy casting lubricant, glycerol trioleate, is used as the lubricant base. This is evidenced by box number 1 in the flow chart. Box number 2 in the flowchart evidences the amount of water and surfactant that is mixed with the lubricant base. About 0.05% to about 0.5% by weight of water could be added to the lubricant base, but about 0.1% to about 0.4% by weight of water is preferred. Similarly, less than about 0.25% by weight of surfactant could be added to the lubricant base, but about 0.05% to about 0.2% of surfactant is preferred. The types of lubricant that can be used include for example, but without limitation, glycerol trioleate, ethyl oleate, methyl oleate, butyl ricinoleate, methyl acetyl ricinoleate, butyl oleate, glycerol triacetyl ricinoleate, butyl acetyl ricinoleate, polyalphaolefins, polyisobutylenes, castor oil, peanut oil, corn oil, canola oil, cottonseed oil, olive oil, rapeseed oil, safflower oil, sesame oil, sunflower oil, soybean oil, linseed oil, coconut oil, palm kernel oil, neat's-foot oil, lard oil, tallow oil, and combinations thereof. Any type of water can be used, but soft water is preferred. For purposes of this invention, soft water is to be defined as water with a low content of polyvalent cations. It will be appreciated by those of ordinary skill in the art that polyvalent cations are ions that have more than one positive charge. Examples of polyvalent cations are calcium ($Ca^{+2}$), magnesium ($Mg^{+2}$), iron ($Fe^{+2}$ and $Fe^{+3}$), and aluminum ($Al^{+3}$). The surfactant can be cationic, anionic, nonionic, or combinations thereof. The surfactant used in this invention was Kimberly Clark® Professional Pink Lotion Soap. This soap is available from the Kimberly Clark Corporation. The mixture is then subjected to high shear for about 5 minutes as represented by box number 3 in the flowchart. High shear is defined as at least 100 revolutions per minute (RPM). Shearing devices including, but not limited to, household blenders, can be used to shear the mixture. The lubricant so formulated, as represented by box number 4 in the flowchart, is applied to a casting mold in any manner that is familiar to those skilled in the art of casting aluminum alloys.

It is believed that a major benefit of the lubricant of this invention is realized in uniformly distributing surface oxides at the meniscus during DC casting of aluminum. However, it is recognized by those skilled in the art that the lubricant of this invention can be used in any thermomechanical processing of aluminum and its alloys. These processing steps include, but are not limited to casting, hot and cold rolling, forging, and extrusion.

Figure 2:
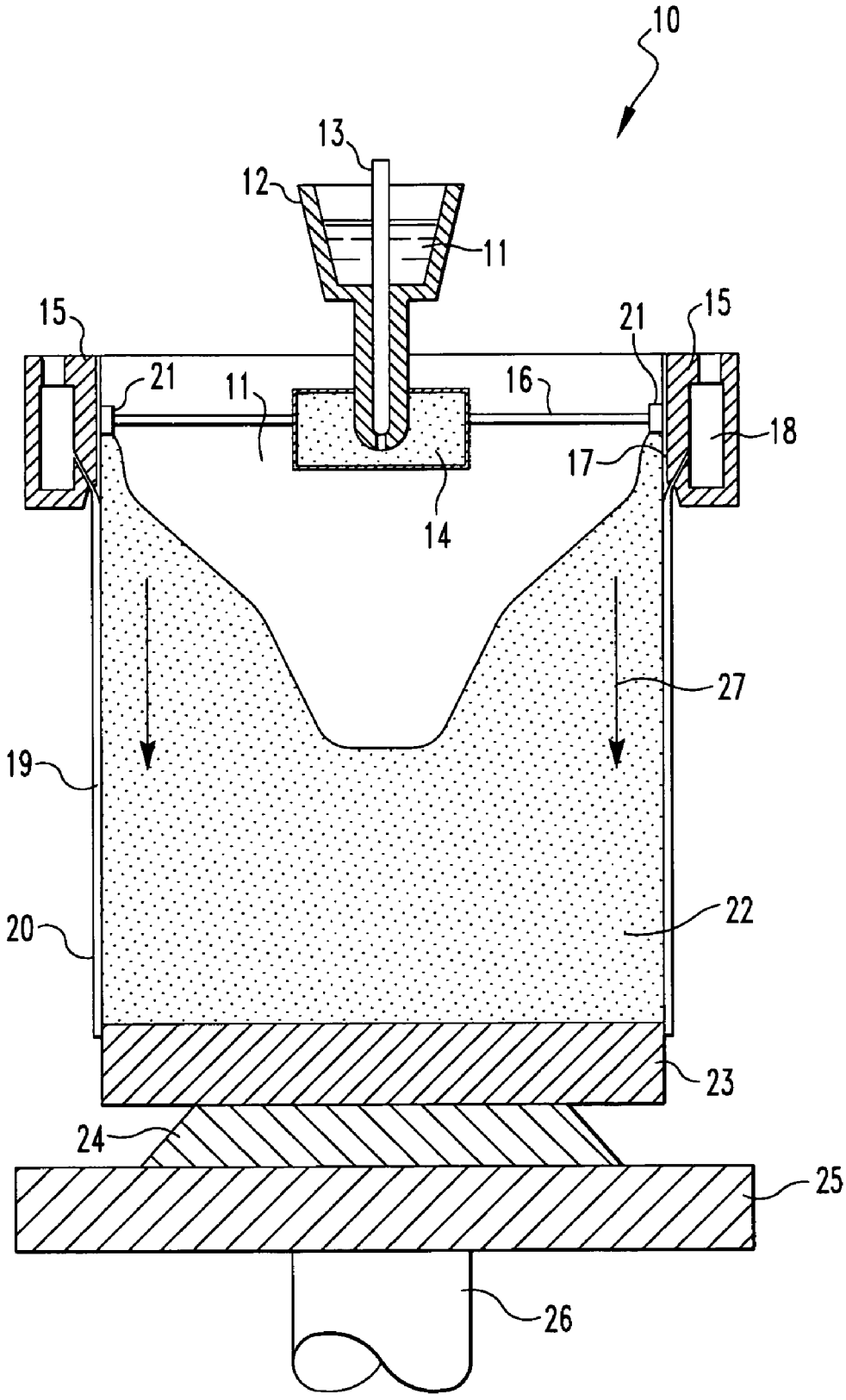
FIG. 2 is a schematic characterization of a DC continuous casting mold used in the method of this invention.

Referring now to FIG. 2, a cross-section of a DC casting mold 10, which can be used to cast aluminum alloy ingots according to the instant invention, is schematically depicted. The DC casting mold 10 comprises molten metal 11 from a furnace. The molten metal is held in a trough 12. A control pin 13 activates and deactivates the flow of molten metal 11 into a distributor bag 14, which distributes the molten metal into the cooled mold 15. The molten metal 11 in the cooled mold 15 may form an oxide skim 16. The inner wall 17 of the cooled mold 15 is cooled by a liquid cooling jacket 18 that cools the mold 15 and floods the solidified ingot surface 19 with cooling liquid 20. The liquid is preferably water, but could be any liquid suitable for cooling the ingot 22. The liquid flows from a liquid pump (not shown) that is connected to the sides of the cooling jacket 18. The inner wall 17 is also continuously lubricated with a formulation of the instant invention by using an oil ring 21 positioned at or near the meniscus of where the molten metal 11 in the mold 15 contacts the inner wall 17 of the cooled mold 15. An oil ring is preferred, but other methods of continuously lubricating the mold inner wall could be used. In a preferred embodiment, the lubricant formulation comprises about 0.1% to about 0.4% by weight of water and 0.05% to about 0.2% by weight of surfactant with the remaining percentage being glycerol trioleate base. Molten metal 11 in the mold 15 solidifies into a solidified ingot 22. The solidified ingot 22 rests on a starting block 23. The starting block 23 rests on a starting block holder 24. The starting block holder 24 is attached to a platen 25. The platen can be lowered or raised by a cylinder ram 26. As molten metal 11 in the mold 15 solidifies into a solidified ingot 22, the cylinder ram 26 is lowered, which causes the solidified ingot 22 to also be lowered according to the directional arrows 27 superimposed onto the schematic cross section of the DC mold 10. As the cylinder ram 26 and solidified ingot 22 are lowered, the control pin 13 is activated to allow more molten metal 11 in the trough 12 to flow into the cooled mold 15 via the distributor bag 14, and ingots of aluminum alloy are cast, the length of such ingots being constrained only by the movement of the cylinder ram 26. During the ingot casting operation, the solidified ingot 22 is in contact with the inner wall 17 and is continuously lubricated with the lubricant of this invention via the oil ring 21 or any other method used to continuously lubricate the mold inner wall, thusly providing a process for minimizing undesirable surface defects, such as vertical folds that were described earlier. During the practice of this invention, there is no requirement for the undesirable practice of alloying the aluminum with beryllium, nor is there any reliance on using toxic materials such as ammonium fluoroborate or boron trifluoride to prevent oxidation during casting.

To test the lubricant formulation, a lubricant was formulated according to the teachings of this invention as described in the following example.

Figure 3A:
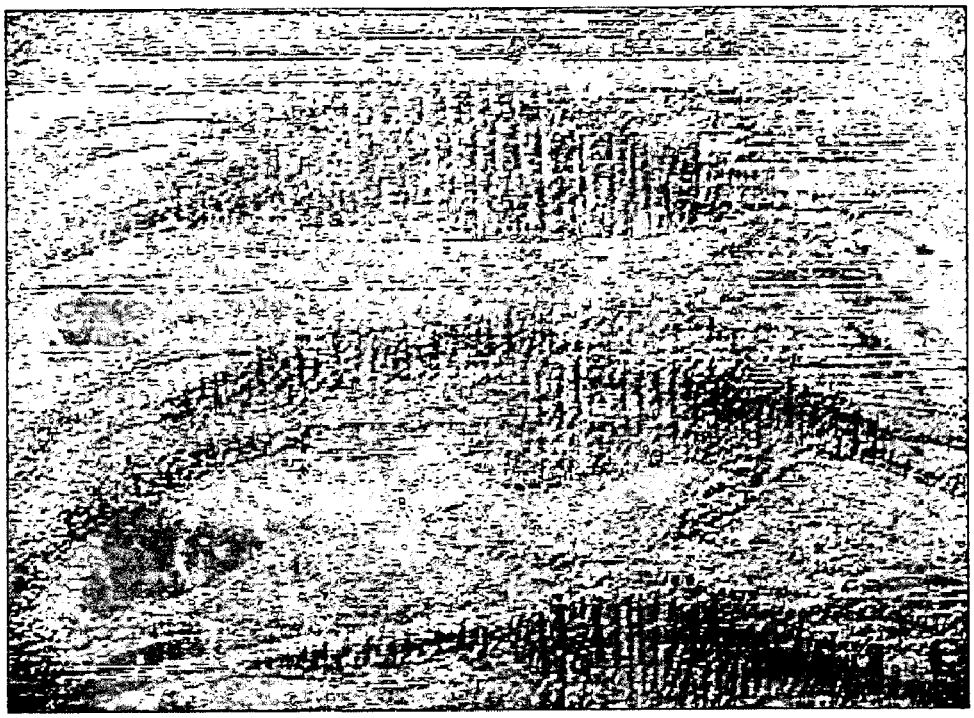
FIGS. 3*a* and 3*b* show the faces of aluminum alloy ingots cast with the use of a standard lubricant and the lubricant formulation of the present invention.
Figure 3B:
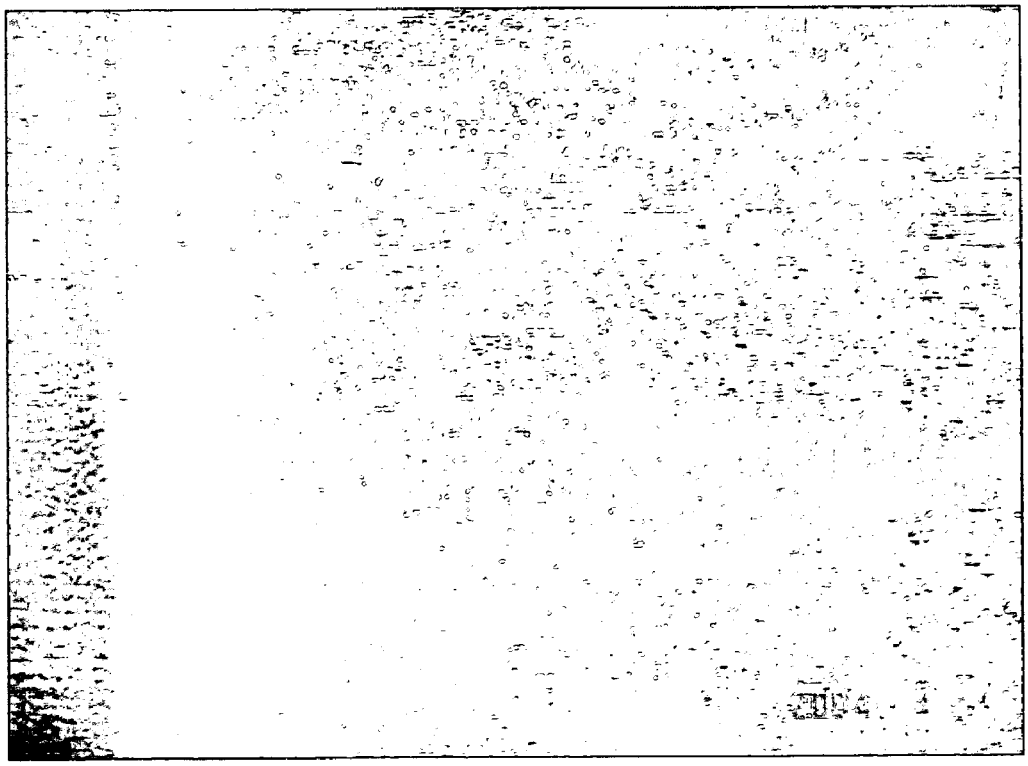

EXAMPLE 7200 grams of glycerol trioleate, 8 grams of water, and 4 grams of Kimberly Clark® Professional Pink Lotion Soap were combined and sheared, via use of a household blender, at high speed (1000 RPM) for five minutes. The lubricant formulation was used in the casting of Aluminum Alloy 5083 and 7050. Casting position 1, which was used as the control, utilized only glycerol trioleate as the lubricant. As can be seen in FIG. 3*a*, the resultant aluminum alloy ingot was covered with vertical folds. Casting position 2 alternated between using glycerol trioleate and the lubricant formulation of the present invention. As represented in FIG. 3*b*, the resultant aluminum alloy ingot had only a few light vertical folds when the lubricant formulation of the present invention was used.

Figure 4:
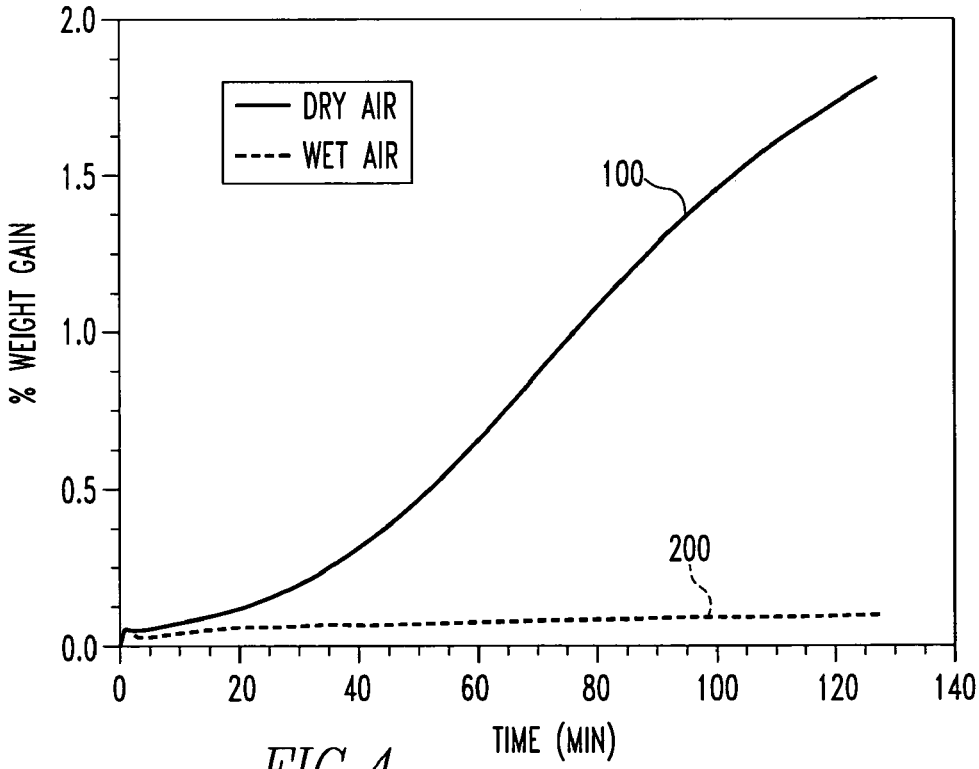
FIG. 4 is a graph showing the isothermal thermogravimetric analysis of 5083 aluminum alloy in dry and wet air.
Figure 5:
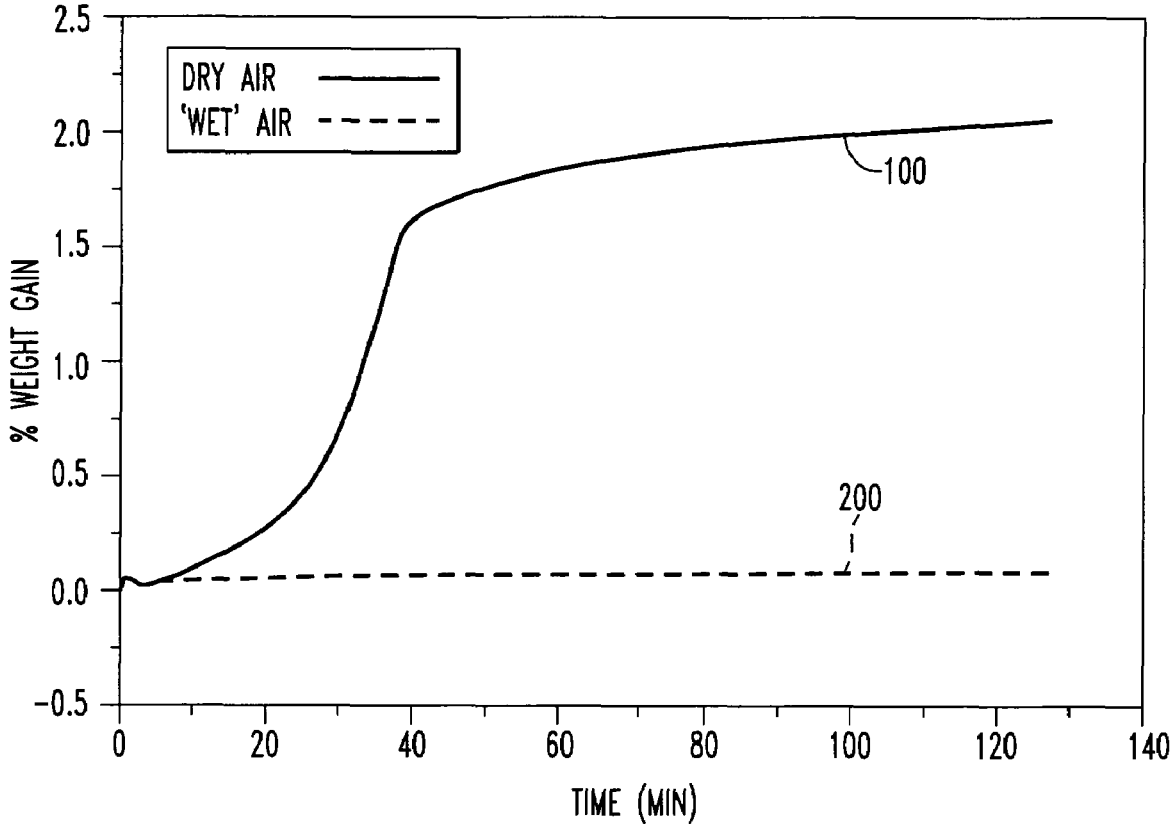
FIG. 5 is a graph showing the isothermal thermogravimetric analysis of 7050 aluminum alloy in dry and wet air.

The distribution of the surface oxide on the ingot head and at the meniscus plays an important role in fold prevention or formation. FIGS. 4 and 5 represent the isothermal thermogravimetric analysis of 5083 and 7050 alloys in dry air 100 and wet air 200, respectively. For purposes of this invention, dry air is air with a dew point of 59° F. or less and wet air with a dew point between 60° F. and 100° F. Data from previous research shows that wet air 200 can produce an oxide/hydroxide film that protects the high magnesium alloy from runaway or uncontrolled magnesium oxidation at molten metal temperatures. Since the weight gain of the magnesium-containing alloys is significantly reduced as compared to dry air 100, the surface oxide is thinner and is believed to be more uniformly distributed. This change in oxide distribution would play a significant role in vertical fold suppression. Introducing the oxygen, in this case in the form of water mixed with oil and surfactant, provides the method for changing the metal oxide distribution at the meniscus. The critical technical part is to form a homogeneous distribution of water in the oil so water would be limited, but available uniformly over the surface of the casting mold and at the meniscus immediately before solidification. The water may be uniformly dispersed in the oil as a dispersion, emulsion, a true solution, or a combination thereof. For purposes of this application, the term dispersion is defined as the distribution of a substance, as fine particles, evenly throughout a medium, the term emulsion is defined as distributing a substance throughout a medium via use of an emulsifier, such as a surfactant, to help link the substance and the medium together, and the term true solution is defined as a homogeneous mixture formed by mixing a solid, liquid, or gaseous substance with a liquid or sometimes a gas or solid. Uniformly distributing the water in this manner reduces vertical folds and the possibility of associated cracking by also controlling the heat transfer between the molten metal and the lubricant interface on the inner wall of the mold, thereby allowing the solidified shell to stay in contact with the mold longer and form a thicker and stronger shell.

It will be readily appreciated by those skilled in the art that modifications may be made to the invention without departing from the concepts disclosed in the forgoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

What is claimed is:

1. An ingot lubricant composition suitable for use in the manufacture of aluminum alloys comprising:

an casting lubricant base selected from the group consisting of solid lubricants, liquid lubricants, grease lubricants, emulsion lubricants, and dispersion lubricants;

a homogeneous distribution of water in the casting lubricant base, the water ranging about 0.05% to about 0.5% by weight; and surfactant, wherein the homogeneous distribution of water in the casting lubricant base and the surfactant provide an ingot lubricant that forms a uniform distribution of surface oxide at a meniscus formed between molten aluminum and an ingot mold sidewall during continuous or semi-continuous casting.

2. The lubricant composition of claim 1 comprising about 0.1% to about 0.4% by weight of said water.

3. The lubricant composition of claim 1 comprising less than about 0.25% by weight of said surfactant.

4. The lubricant composition of claim 3 comprising about 0.05% to about 0.2% by weight of said surfactant.

5. The lubricant composition of claim 1 wherein said surfactant is selected from the group consisting of: a cationic surfactant, anionic suifactant, nonionic surfactant, or any combination thereof.

6. The lubricant composition of claim 1 sheared at high speed prior to use in the manufacture of aluminum alloys.

7. A lubricant composition for use in the casting of aluminum alloys comprising a casting lubricant base selected from the group consisting of glycerol trioleate, ethyl oleate, methyl oleate, butyl ricinoleate, methyl acetyl ricinoleate, butyl oleate, glycerol triacetyl ricinoleate, butyl acetyl ricinoleate, polyalphaolefins, polyisobutylenes, castor oil, peanut oil, corn oil, canola oil, cottonseed oil, olive oil, rapeseed oil, safflower oil, sesame oil, sunflower oil, soybean oil, linseed oil, coconut oil, palm kernel oil, neat's-foot oil, lard oil, tallow oil, and combinations thereof; a homogeneous distribution of water in the casting lubricant base, the water ranging about 0.05% to about 0.5% by weight; and surfactant, wherein the homogeneous distribution of water in the casting lubricant base and the surfactant provide an ingot lubricant that forms a uniform distribution of surface oxide at a meniscus formed between molten aluminum and an ingot mold sidewall during continuous or semi-continuous casting.

8. The lubricant composition of claim 7 comprising about 0.1% to about 0.4% by weight of said water.

9. The lubricant composition of claim 7 comprising less than about 0.25% by weight of said surfactant.

10. The lubricant composition of claim 9 comprising about 0.05% to about 0.20% by weight of said surfactant.

11. The lubricant composition of claim 7 wherein said surfactant is selected from the group consisting of: a cationic surfactant, anionic surfactant, nonionic surfactant, or any combination thereof.

12. The lubricant composition of claim 7 sheared at high speed prior to use in the casting of aluminum alloys.

13. A ingot lubricant composition for use in the casting of aluminum alloys comprising;

a casting lubricant oil base selected from the group consisting of glycerol trioleate, ethyl oleate, methyl oleate, butyl ricinoleate, methyl acetyl ricinoleate, butyl oleate, glycerol triacetyl ricinoleate, butyl acetyl ricinoleate, castor oil, peanut oil, corn oil, canola oil, cottonseed oil, olive oil, rapeseed oil, safflower oil, sesame oil, sunflower oil, soybean oil, linseed oil, coconut oil, palm kernel oil, neat's-foot oil, lard oil, tallow oil, and combinations thereof; a homogeneous distribution of water in the casting lubricant oil base, the water ranging about 0.05% to about 0.5% by weight; and a surfactant, wherein the homogeneous distribution of water in the casting lubricant oil base and the surfactant provide an ingot lubricant that forms a uniform distribution of surface oxide at a meniscus formed between molten aluminum and an ingot mold sidewall during continuous or semi-continuous casting.

14. The lubricant composition of claim 13 comprising about 0.1% to about 0.4% by weight of said water.

15. The lubricant composition of claim 13 comprising less than about 0.25% by weight of said surfactant.

16. The lubricant composition of claim 15 comprising about 0.05% to about 0.20% by weight of said surfactant.

17. The lubricant composition of claim 13 wherein said surfactant is selected from the group consisting of: a cationic surfactant, anionic surfactant, nonionic surfactant, or any combination thereof.

18. The lubricant of claim 13 sheared at high speed prior to use in the casting of aluminum alloys.

19. A lubricant composition for use in the casting of aluminum alloys comprising: an existing casting lubricant oil base selected from the group consisting of glycerol trioleate, castor oil, and combinations thereof, the improvement wherein said lubricant composition further comprises: a homogeneous distribution of water in the casting lubricant base, the water ranging about 0.05% to about 0.5% by weight; and surfactant, wherein the homogeneous distribution of water in the casting lubricant oil base and the surfactant provide an ingot lubricant that forms a uniform distribution of surface oxide at a meniscus formed between molten aluminum and an ingot mold sidewall during continuous or semi-continuous casting.

20. The lubricant composition of claim 19 comprising about 0.10% to about 0.40% by weight of said water.

21. The lubricant composition of claim 19 comprising less than about 0.25% by weight of said surfactant.

22. The Lubricant composition of claim 21 comprising about 0.05% to about 0.20% by weight of said surfactant.

23. The lubricant composition of claim 19 wherein said surfactant is selected from the group consisting of: a cationic surfactant, anionic surfactant, nonionic surfactant, or any combination thereof.

24. The lubricant of claim 19 sheared at high speed prior to use in the casting of aluminum alloys.

25. An ingot lubricant composition for use in the casting of aluminum alloys comprising glycerol trioleate and about 0.05% to about 0.50% by weight of water and less than about 0.25% by weight of surfactant.

26. The lubricant composition of claim 25 comprising about 0.1% to about 0.4% by weight of said water.

27. The lubricant composition of claim 25 comprising about 0.05% to about 0.2% by weight of said surfactant.

28. The lubricant composition of claim 25 wherein said surfactant is selected from the group consisting of: a cationic surfactant, anionic surfactant, nonionic surfactant, or any combination thereof.

29. The lubricant of claim 25 sheared at high speed prior to use in the casting of aluminum alloys.

30. A process for the continuous or semi-continuous casting of aluminum alloys wherein molten aluminum alloy is cast into a cooled mold having a lubricated inner mold wall, said process comprising the steps of:

a) lubricating the inner wall of a cooled, continuous or semi-continuous casting mold with a lubricant composition comprising:

i) a casting lubricant base selected from the group consisting of glycerol trioleate, ethyl oleate, methyl oleate, butyl ricinoleate, methyl acetyl ricinoleate, butyl oleate, glycerol triacetyl ricinoleate, butyl acetyl ricinoleate, polyalphaolefins, polyisobutylenes, castor oil, peanut oil, corn oil, canola oil, cottonseed oil, olive oil, rapeseed oil, safflower oil, sesame oil, sunflower oil, soybean oil, linseed oil, coconut oil, palm kernel oil, neat's-foot oil, lard oil, tallow oil, and combinations thereof, and;

ii) a homogeneous distribution of water in the casting lubricant base, the water ranging about 0.05% to about 0.5% by weight, and surfactant; and b) casting a molten aluminum alloy into said mold, wherein said lubricant is in continuous contact with a meniscus formed between the molten aluminum alloy and the mold, wherein the homogeneous distribution of water in the casting lubricant base allows for uniform distribution of the surface oxide at the meniscus of said lubricated inner mold wall and said molten aluminum base alloy.

31. The process of claim 30 comprising about 0.10% to about 0.40% by weight of said water.

32. The process of claim 30 comprising less than about 0.25% by weight of said surfactant.

33. The process of claim 32 comprising about 0.05% to about 0.20% by weight of said surfactant.

34. The process of claim 30 wherein said surfactant is selected from the group consisting of: a cationic surfactant, anionic surfactant, nonionic surfactant, or any combination thereof.

35. The process of claim 30 sheared at high speed prior to use in the casting of aluminum alloys.

* * * * *

UNITED STATES PATENT AND TRADEMARK OFFICE

CERTIFICATE OF CORRECTION

PATENT NO. : 7,273,086 B2
APPLICATION NO. : 10/974384
DATED : September 25, 2007
INVENTOR(S) : Ray T. Richter et al.

It is certified that error appears in the above-identified patent and that said Letters Patent is hereby corrected as shown below:

On the Title Page, Item (75), sixth inventor, delete the last name "Weiserman" and insert --Wieserman--.

In column 2, line 51, after 'adverse', delete "affect" and insert --effect--.

In column 6, line 45, line 3 of claim 1, before 'casting', delete "an" and insert --a--.

In column 7, line 33, line 1 of claim 13, before 'ingot', delete "A" and insert --An--.

Signed and Sealed this

Sixth Day of May, 2008

JON W. DUDAS
*Director of the United States Patent and Trademark Office*